US008100710B1

(12) United States Patent
Peng et al.

(10) Patent No.: US 8,100,710 B1
(45) Date of Patent: Jan. 24, 2012

(54) FLASH DRIVE MOUNTING APPARATUS HAVING A BASE WITH A PLURALITY OF OPENINGS AND TWO FIXING MEMBERS WITH HOOK-AND-LOOP FASTENERS

(75) Inventors: Wen-Tang Peng, Taipei Hsien (TW); Zhe Zhang, Shenzhen (CN); Bing-Bao Guo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/957,255

(22) Filed: Nov. 30, 2010

(30) Foreign Application Priority Data

Oct. 18, 2010 (CN) ..... 201010510092

(51) Int. Cl.
*H01R 13/62* (2006.01)

(52) U.S. Cl. ..... 439/369

(58) Field of Classification Search ..... 439/367–371, 439/353

See application file for complete search history.

(56) References Cited

U.S. PATENT DOCUMENTS

| | | | | |
|---|---|---|---|---|
| 4,869,683 | A * | 9/1989 | Nelson | 439/369 |
| 5,732,445 | A * | 3/1998 | Stodolka et al. | 24/16 R |
| 5,733,138 | A * | 3/1998 | Kramer | 439/369 |
| 5,745,958 | A * | 5/1998 | Kaldor | 24/16 R |
| 5,782,648 | A * | 7/1998 | Peterson | 439/369 |
| 7,674,138 | B2 * | 3/2010 | Mori | 439/701 |
| 8,052,455 | B1 * | 11/2011 | Peng et al. | 439/353 |
| 2009/0143689 | A1 * | 6/2009 | Berry et al. | 600/508 |
| 2011/0204843 | A1 * | 8/2011 | Foster | 320/101 |

* cited by examiner

*Primary Examiner* — Chandrika Prasad
(74) *Attorney, Agent, or Firm* — Altis Law Group, Inc.

(57) ABSTRACT

A mounting apparatus is used to fix a flash drive mounted on a circuit board. The mounting apparatus includes a base, a first fixed member, and a second fixed member. The base includes a main body, a first fixed portion, and a second fixed portion. The first fixed member includes an opening, and a first hook-and-loop fastener. The first fixed member passes through the first fixed portion, and the opening for fixing the first fixed member to the base. The second fixed member includes two second hook-and-loop fasteners. Two ends of the second fixed member pass through the second fixed portion for fixing the second fixed member to the base. The first fixed member passes over the flash drive and fixes to the second fixed member by the first hook-and-loop fastener attached to one of the two second hook-and-loop fasteners for engaging the flash drive with a connector.

11 Claims, 3 Drawing Sheets

FLASH DRIVE MOUNTING APPARATUS HAVING A BASE WITH A PLURALITY OF OPENINGS AND TWO FIXING MEMBERS WITH HOOK-AND-LOOP FASTENERS

CROSS-REFERENCE OF RELATED APPLICATIONS

Relevant subject matter is disclosed in a co-pending U.S. patent application, titled "MOUNTING APPARATUS FOR FLASH DRIVE" with the application Ser. No. 12/912,779, which is assigned to the same assignee as this patent application.

BACKGROUND

1. Technical Field

The present disclosure relates to device mounting, and particularly, to a mounting apparatus for flash drives.

2. Description of Related Art

In some computers, programs for driving some elements mounted on circuit boards of the computers are stored in flash drives, such as universal serial bus (USB) flash drives, which are detachable from the computers. However, these USB flash drives are generally engaged with connectors of the computers directly. As a result, the USB flash drives may easily disengage from the corresponding connectors after impact and vibration of the computers or the USB flash drives.

Therefore, a mounting apparatus is desired to overcome the limitations described.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
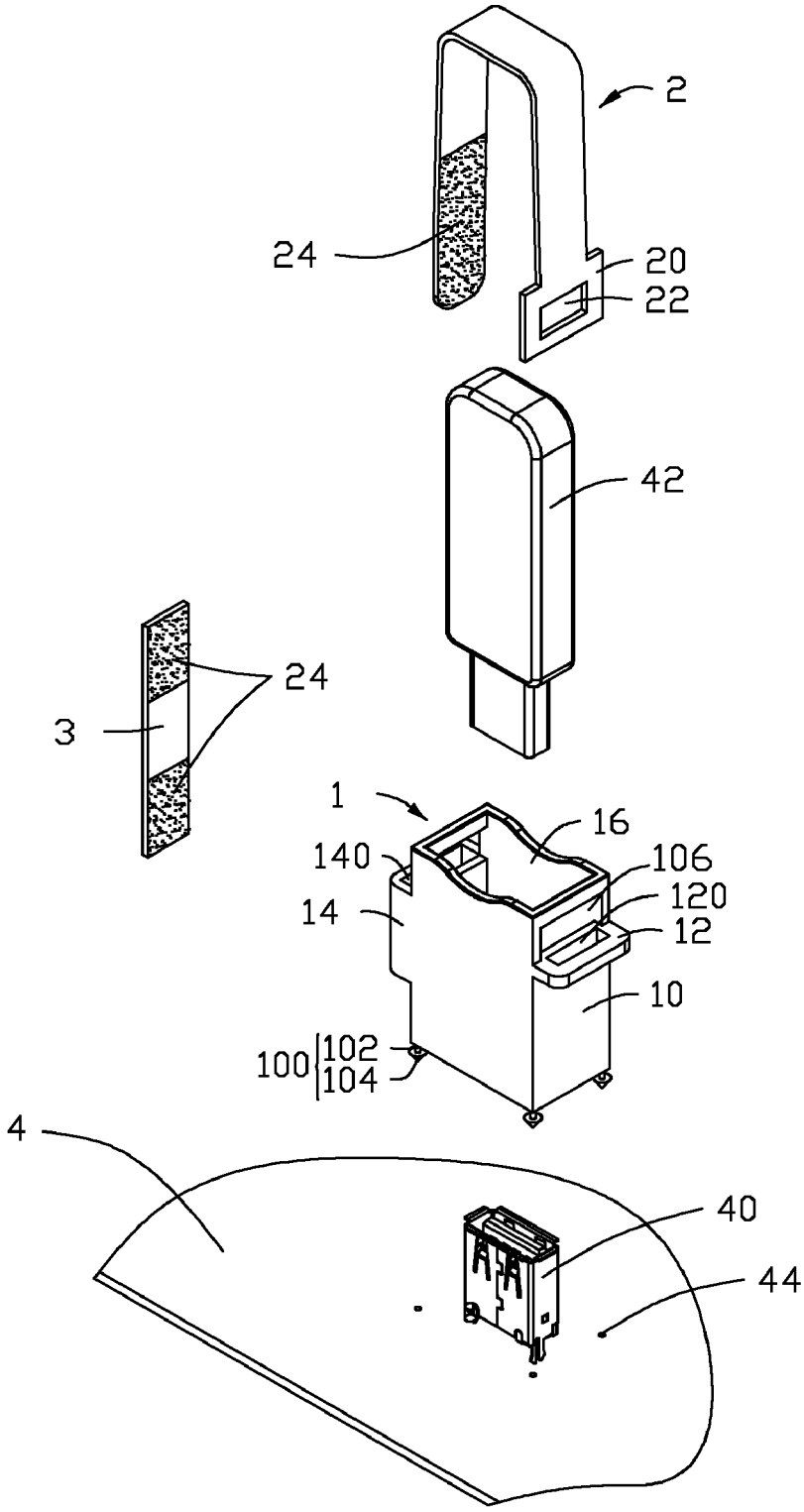
FIG. 1 is an exploded, isometric view of an exemplary embodiment of a mounting apparatus, applied with a universal serial bus (USB) flash drive.

Referring to FIG. 1, an exemplary embodiment of a mounting apparatus is used to fix a flash drive, such as a universal serial bus (USB) flash drive 42, which is engaged with a connector 40 mounted on a circuit board 4. The mounting apparatus includes a base 1, a strap-shaped first fixing member 2 and a strap-shaped second fixing member 3. The first fixing member 2 is longer than the second fixing member 3.

The base 1 includes a main body 10, a first fixed portion 12 extending from a first side of the main body 10, and a second fixed portion 14 extending from a second side of the main body 10. The main body 10 is hollow and substantially rectangular cube shaped, and defines an accommodating space 16 in the main body 10, a first through hole 106 in the first side of the main body 10, and a second through hole 108 (see FIG. 3) in the second side of the main body 10. The first through hole 106 is positioned above the first fixed portion 12, and the second through hole 108 is positioned above the second fixed portion 14. A third fixing member 100 extends from each of four corners of a bottom side of the main body 10, each of which includes a post 102 extending from the bottom side and a tapered latch 104 extending from a distal end of the post 102 opposite to the bottom side of the main body 10. Each of the latches 104 can be deformed. The first fixed portion 12 and the second fixed portion 14 are substantially U-shaped. The first portion 12 and the first side of the main body 10 cooperatively define a first receiving space 120 therebetween. The second fixed portion 14 and the second side of the main body 10 cooperatively define a second receiving space 140 therebetween.

The first fixing member 2 includes an opening 22 defined at a first end 20 of the first fixing member 2, and a first hook-and-loop fastener 24 positioned on an inside surface of a second end 21 of the first fixing member 2.

The second fixing member 3 includes two second hook-and-loop fasteners 34 positioned on two opposite surfaces of the second fixing member 3.

The circuit board 4 defines four fixed holes 44 therein around the connector 40 corresponding to the third fixing members 100 of the main body 10.

Figure 2:
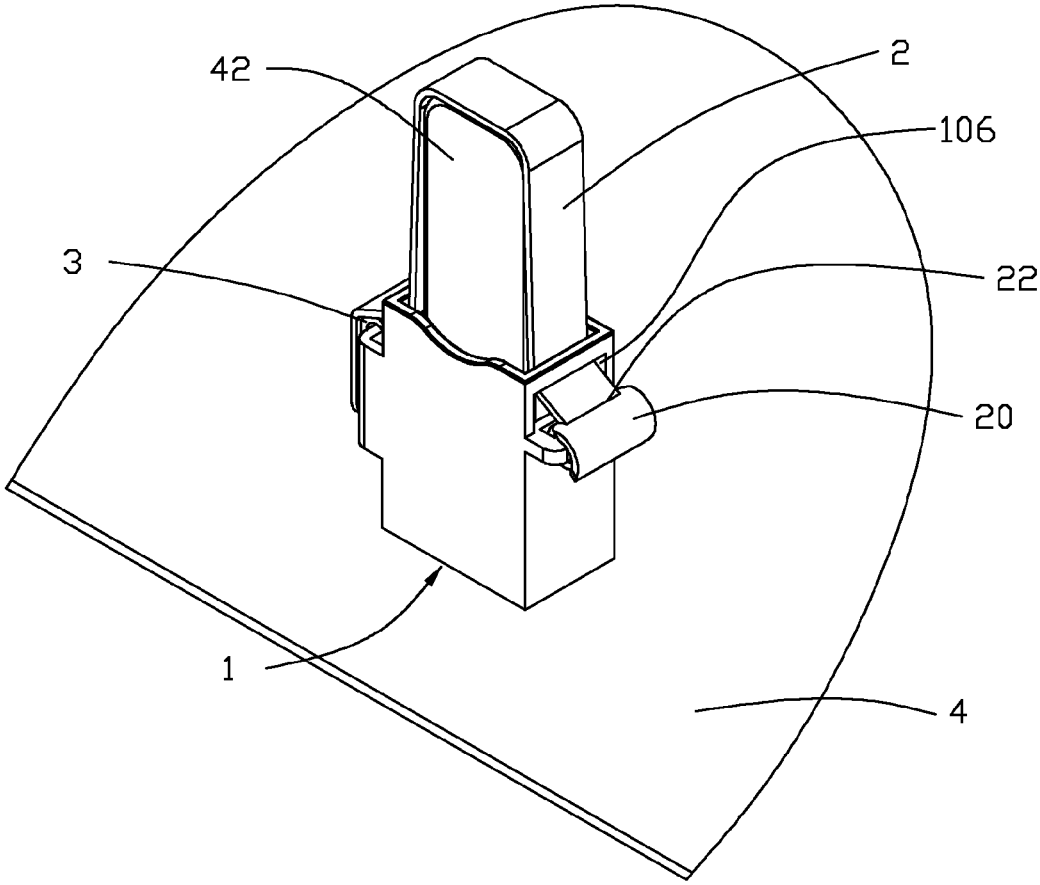
FIG. 2 is an assembled, isometric view of FIG. 1.
Figure 3:
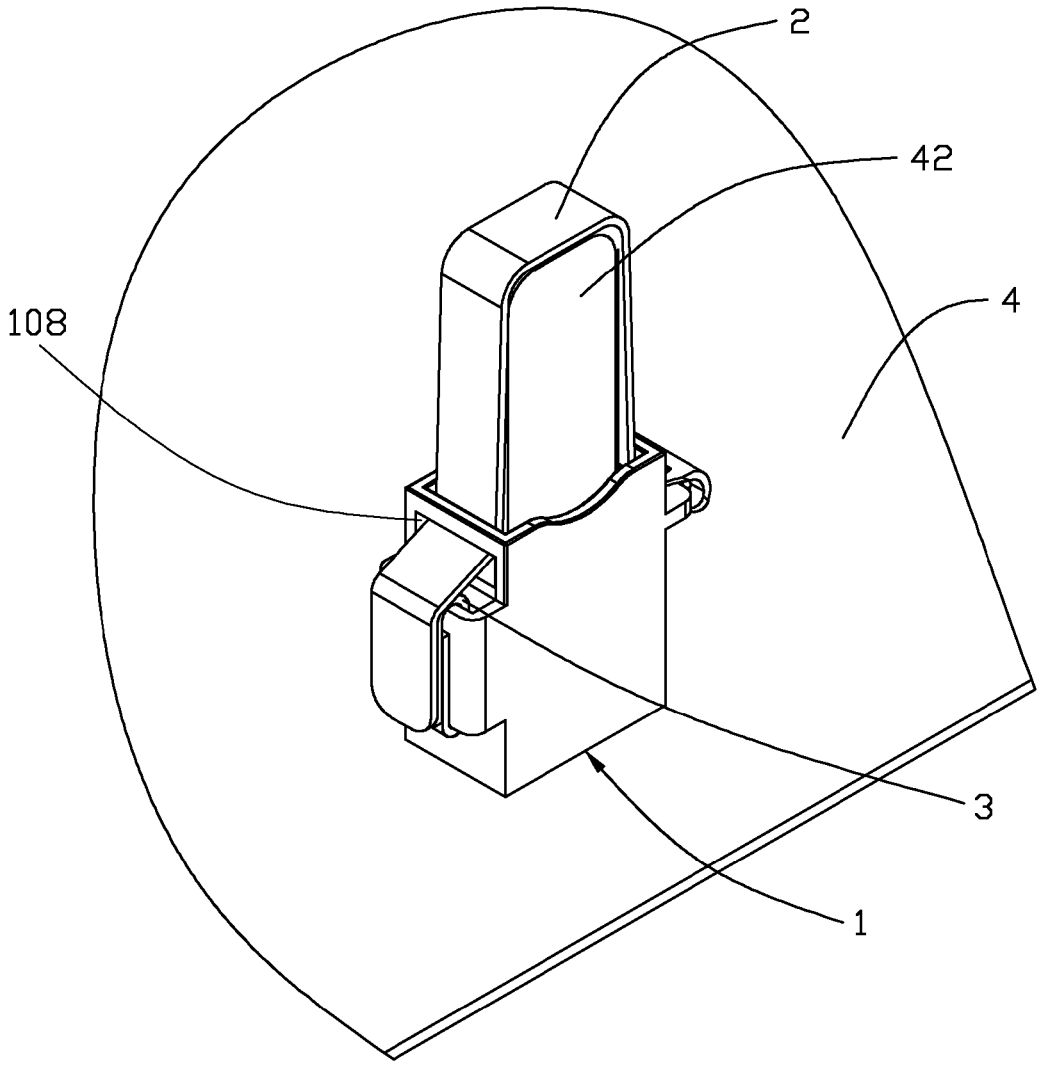
FIG. 3 is an assembled, isometric view of FIG. 1, but viewed from another aspect.

Referring to FIGS. 2-3, in assembly of the first fixing member 2 to the base 1, the opening 22 of the first fixing member 2 is aligned with the first receiving space 120 of the first fixed portion 12, and the second end of the first fixing member 2 passes through the first receiving space 120 and the opening 22 from upper to lower. The second end of the first fixing member 2 then passes over the first fixed portion 12 and passes through the first through hole 106 from outer to inner. Accordingly, the first fixing member 2 and the base 1 can be fixed to each other.

In assembly of the second fixing member 3 to the base 1, a center of the second fixing member 3 is aligned with a center of the second fixed portion 14, and two ends of the second fixing member 3 pass inward through the second receiving space 140 of the second fixed portion 14. The two ends of the second fixing member 3 then attach to each other by the two second hook-and-loop fasteners 34. Accordingly, the second fixing member 3 and the base 1 can be fixed to each other.

In assembly of the base 1 to the circuit board 4, the tapered latches 104 of the corresponding third fixing members 100 of the base 1 are deformed to extend through the corresponding fixed holes 44 of the circuit board 4. Then blocked by the circuit board 4, to mount the base 1 to the circuit board 4, with the connector 40 is received in the receiving space 16 of the base 1 through the bottom side of the base 1.

In use, the USB flash drive 42 is inserted into the receiving space 16, the second end of the first fixing member 2 passes over a top end of the USB flash drive 42 and passes through the second through hole 108 from inner to outer. The second end of the first fixing member 2 then fixes to the second fixing member 3 by the first hook-and-loop fastener 24 attaching to one of the two second hook-and-loop fasteners 34. Accordingly, the USB flash drive 42 is received in the connector 40, with the first fixing member 2 fixes to the second fixing member 3.

In another embodiment, as a length of the first fixing member 2 can be adjusted, the mounting apparatus may be used to fix other sizes of USB flash drives.

While the disclosure has been described by way of example and in terms of preferred embodiment, it is to be understood that the invention is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A mounting apparatus used to fix a flash drive to a connector of a circuit board, the mounting apparatus comprising:

a base comprising a main body, a first fixed portion extending from a first side of the main body, and a second fixed portion extending from a second side of the main body, wherein the main body defines an accommodating space therein for receiving the flash drive, a first through hole in the first side of the main body, and a second through hole in the second side of the main body;

a first fixing member comprising an opening defined in a first end of the first fixing member, and a first hook-and-loop fastener positioned on a second end of the first fixing member, wherein the second end of the first fixing member is capable of passing through the first fixed portion, the opening, and the first through hole for fixing the first fixing member to the base; and a second fixing member comprising two second hook-and-loop fasteners positioned on two opposite surfaces of the second fixing member, wherein two ends of the second fixing member are capable of passing through the second fixed portion and attach to each other by the two second hook-and-loop fasteners for fixing the second fixing member to the base;

wherein the second end of the first fixing member is operable to pass over a top end of the flash drive, and pass through the second through hole, and fix to the second fixing member by the first hook-and-loop fastener attached to one of the two second hook-and-loop fasteners for engaging the flash drive with the connector.

2. The mounting apparatus of claim 1, wherein the main body is hollow and substantially rectangular cube shaped, and further comprises a third fixing member extending from each of four corners of a bottom side of the main body for fixing the base to the circuit board.

3. The mounting apparatus of claim 2, wherein each of the third fixing members comprises a post extending from the bottom side, and a tapered latch extending from a distal end of the post to extend through the circuit board and be blocked by the circuit board.

4. The mounting apparatus of claim 1, wherein the first fixed portion and the second fixed portion are substantially U-shaped.

5. The mounting apparatus of claim 4, wherein first fixed portion and the main body cooperatively define a first receiving space therebetween, and the second fixed portion and the main body cooperatively define a second receiving space therebetween.

6. The mounting apparatus of claim 5, wherein the second end of the first fixing member passes through the first receiving space of the first fixed portion and the opening from upper to lower.

7. The mounting apparatus of claim 6, wherein the second end of the first fixing member passes through the first through hole from outer to inner and passes through the second through hole from inner to outer.

8. The mounting apparatus of claim 5, wherein the two ends of the second fixing member pass inward through the second receiving space of the second fixed portion and attach to each other by the two second hook-and-loop fastener.

9. The mounting apparatus of claim 1, wherein the flash drive is a universal serial bus (USB) flash drive.

10. The mounting apparatus of claim 1, wherein both the first fixing member and the second fixing member are strap-shaped, and the first fixing member is longer than the second fixing member.

11. The mounting apparatus of claim 1, wherein the first through hole is positioned above the first fixed portion, and the second through hole is positioned above the second fixed portion.

* * * * *